US011814920B2

(12) United States Patent
Roselier et al.

(10) Patent No.: US 11,814,920 B2
(45) Date of Patent: Nov. 14, 2023

(54) SYSTEM AND METHODOLOGY FOR THROUGH TUBING PATCHING

(71) Applicant: Saltel Industries, Bruz (FR)

(72) Inventors: Samuel Roselier, Bruz (FR); James Leighton, Bruz (FR); Benjamin Saltel, Bruz (FR); Robin McGowan, Dubai (AE); Juan Miguel La Rotta Marin, Aberdeen (GB); Gareth Brown, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 186 days.

(21) Appl. No.: 17/423,720

(22) PCT Filed: Jan. 21, 2020

(86) PCT No.: PCT/EP2020/051430
§ 371 (c)(1),
(2) Date: Jul. 16, 2021

(87) PCT Pub. No.: WO2020/152179
PCT Pub. Date: Jul. 30, 2020

(65) Prior Publication Data

US 2022/0081986 A1 Mar. 17, 2022

(30) Foreign Application Priority Data

Jan. 21, 2019 (EP) ..... 19305074

(51) Int. Cl.
*E21B 29/10* (2006.01)
*E21B 33/127* (2006.01)
*E21B 43/10* (2006.01)

(52) U.S. Cl.
CPC ..... *E21B 29/10* (2013.01); *E21B 33/127* (2013.01); *E21B 43/105* (2013.01)

(58) Field of Classification Search
CPC ..... E21B 29/10; E21B 33/127; E21B 43/105; E21B 43/103
See application file for complete search history.

(56) References Cited

U.S. PATENT DOCUMENTS 5,833,001 A * 11/1998 Song ..... E21B 29/10 166/57
7,401,647 B2 * 7/2008 Baycroft ..... E21B 43/103 29/402.09

(Continued)

FOREIGN PATENT DOCUMENTS

EP 2538018 A1 12/2012
EP 3255240 A1 12/2017

(Continued)

OTHER PUBLICATIONS

International Search Report and Written Opinion issued in PCT Application PCT/EP2020/051430, dated Mar. 26, 2020 (15 pages).

*Primary Examiner* — Jonathan Malikasim
(74) *Attorney, Agent, or Firm* — Michael Wills, III

(57) ABSTRACT

A technique facilitates patching of a tubing (42), e.g. casing (36), in a downhole environment (32). The technique employs a patching system comprising a plurality of expansion rings (48). The expansion rings (48) are moved downhole to a patch zone (38) along the tubing (34). Once in a desired position at the patch zone, the expansion rings (48) are expanded into engagement with an inner surface of the tubing. For example, the expansion rings may comprise seal elements (52) and/or anchor elements which are expanded into engagement with the inside surface. The patching system further comprises a patch (68) which may have a tubular shape. The patch is radially expanded in a manner (Continued)

which maintains a sealing engagement with the plurality of expansion rings (48) to create a sealed patch across a desired region in the patch zone.

20 Claims, 11 Drawing Sheets

(56) References Cited

U.S. PATENT DOCUMENTS

| | | | | |
|---|---|---|---|---|
| 8,235,075 | B2 * | 8/2012 | Saltel | E21B 29/10 166/212 |
| 2007/0095532 | A1 * | 5/2007 | Head | E21B 43/105 166/207 |
| 2012/0205092 | A1 | 8/2012 | Givens et al. | |
| 2016/0230496 | A1 | 8/2016 | Lastra | |

FOREIGN PATENT DOCUMENTS

| | | | |
|---|---|---|---|
| EP | 3415711 | A1 | 12/2018 |
| GB | 2396635 | A | 6/2004 |
| GB | 2501417 | A | 10/2013 |

* cited by examiner

SYSTEM AND METHODOLOGY FOR THROUGH TUBING PATCHING

BACKGROUND

In many well applications, various types of tubing strings may be deployed downhole to facilitate production of desired fluids, e.g. gas and/or oil, from the subterranean formation. By way of example, production tubing and various other types of equipment may be deployed downhole within an outer tubing, such as well casing. Sometimes damage to the well casing may occur due to corrosion, impacts, and/or other types of occurrences which can lead to holes extending laterally through the wall of the casing. Such holes can lead to undesirable leaks between the exterior and interior of the casing.

SUMMARY

In general, a system and methodology are provided for patching a tubing, e.g. casing, in a downhole environment. The technique employs a patching system comprising a plurality of expansion rings. The expansion rings are moved downhole to a patch zone along the tubing. Once in a desired position at the patch zone, the expansion rings are expanded into engagement with an inner surface of the tubing. For example, the expansion rings may comprise seal elements and/or anchor elements which are expanded into engagement with the inner surface. The patching system further comprises a patch which may have a tubular shape. The patch is radially expanded in a manner which maintains a sealing engagement with the plurality of expansion rings to create a sealed patch across a desired region in the patch zone. In some embodiments, the expansion rings also may comprise additional support rings to help prevent collapse of the tubular patch. For example, additional expansion rings may be added to enable setting a larger patch and/or sealing a larger zone.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
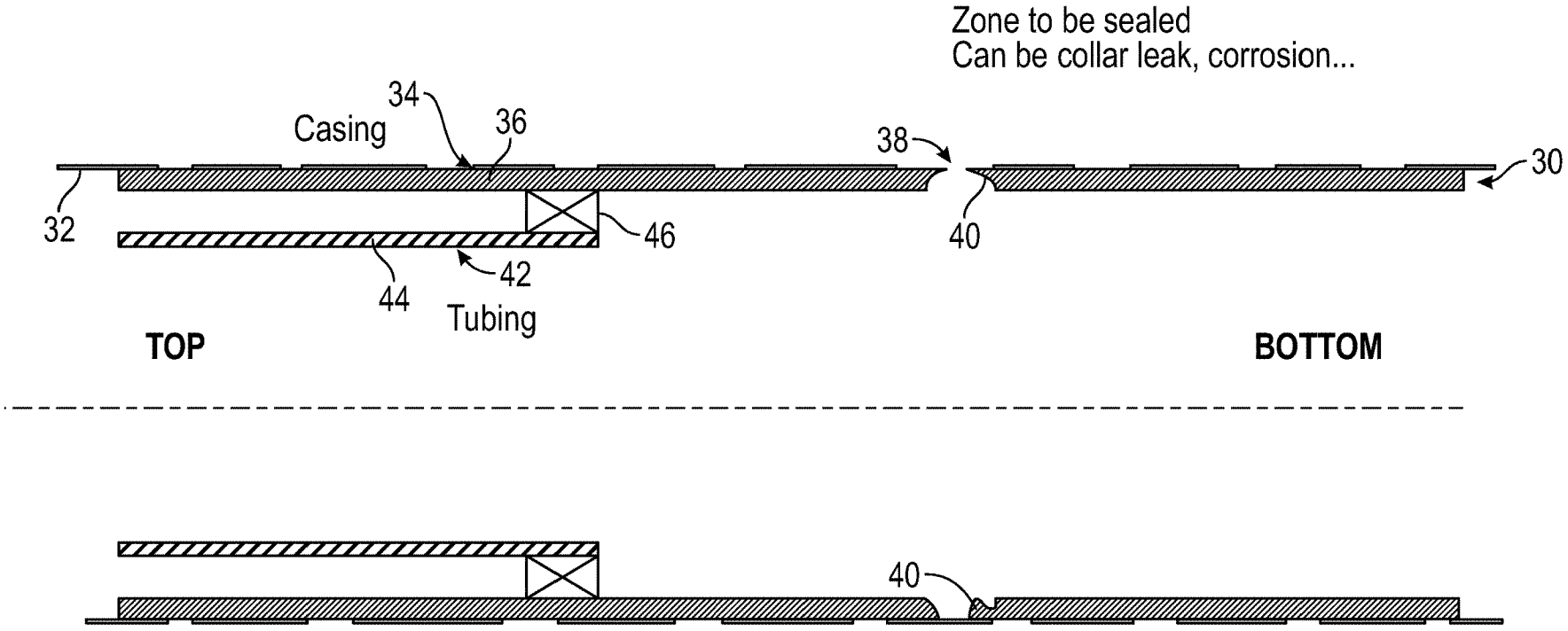
FIG. 1 is a cross-sectional illustration of an inner tubing disposed within an outer tubing located in a borehole, e.g. a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for patching a tubing, e.g. a casing, in a downhole environment. The technique employs a patching system comprising a plurality of expansion rings. The expansion rings are moved downhole to a patch zone along the tubing. By way of example, the patch zone may have a hole or holes extending laterally through a wall forming the casing or other tubing. The hole or holes may be a result of corrosion, impact, or other types of damage to the tubing.

Once the expansion rings are in a desired position at the patch zone, the expansion rings are then expanded into engagement with an inner surface of the tubing. An expansion device, e.g. an expansion device with an inflatable element, may be used to radially expand the expansion rings into engagement with the inner surface. In some embodiments, the expansion device is coupled with a conveyance, e.g. tubing, cable, wireline, or another suitable conveyance, and used to deploy the expansion rings to the desired position at the patch zone.

According to an embodiment, the expansion rings may comprise seal elements and/or anchor elements which are expanded into engagement with the inside surface. In some embodiments, some of the expansion rings have seal elements which may be in the form of elastomeric seal elements; and other expansion rings have anchor elements to securely grip the inner surface of the casing/tubing. The patching system further comprises a patch having, for example, a tubular shape. The patch is radially expanded in a manner which maintains a sealing engagement with the plurality of expansion rings to create a sealed patch across a desired region in the patch zone. The patch also may be expanded by the expansion device during a separate run in hole. However, some embodiments may employ the patch together with the expansion rings, and then the expansion device may be used to simultaneously expand the patch and the expansion rings. Expansion rings also may be added to enable setting a larger patch and/or sealing a larger zone.

Regardless, the expanded tubular patch is maintained in sealing engagement with the expansion rings once expanded. For example, the expanded tubular patch may have an elastomeric surface or other type of surface formed to create a seal with an interior of at least one expansion ring on both the downhole and uphole side of the opening or openings which extend laterally through the wall of the casing/tubing. In some embodiments, the expansion rings also may comprise additional support rings to help prevent collapse of the tubular patch.

The expansion rings and patch are sized for movement through a smaller tubing, e.g. a production tubing. Once moved past a downhole end of the smaller tubing, the expansion rings and patch may be expanded radially outward for patching a larger tubing, e.g. a surrounding casing. Using the combined patch and expansion rings provides a through tubing solution for creating a straddle within a larger bore tubing once the expansion rings and the patch are moved through a smaller bore tubing, e.g. an upper production tubing. The expandability also enables a plurality of patches to be conveyed downhole and set at a plurality of corresponding patch zones. For example, subsequently deployed expansion rings and patches may be moved through existing, expanded patch systems to additional patch zones.

Referring generally to FIG. 1, an example of a downhole system 30 is illustrated as deployed in a borehole 32, e.g. a wellbore. The downhole system 30 comprises an outer tubing 34 deployed along the borehole 32. By way of example, the outer tubing 34 may be in the form of a well casing 36. The outer tubing 34 is illustrated as having a patch zone 38 which includes at least damaged area 40, e.g. a hole or holes.

In the illustrated example, the damaged area 40 is in the form of at least one hole extending laterally through the wall forming outer tubing 34. The hole 40 may be the result of corrosion, impact, or other types of damage that can lead to a leak between the exterior and interior of outer tubing 34.

As illustrated, the downhole system 30 further comprises an inner tubing 42 disposed within the outer tubing 34 and extending a portion of the distance to the patch zone 38. By way of example, the inner tubing 42 may be in the form of production tubing 44 or other well tubing used for a given downhole application. In the illustrated example, a seal member 46, e.g. a packer, is disposed between the downhole end of the inner tubing 42 and the outer tubing 34. It should be noted the borehole 32 may have a vertical orientation or a variety of deviated, e.g. horizontal, orientations and that the bottom side of the patch zone 38 is the downhole side and the top side of the patch zone 38 is the uphole side.

In a variety of applications, the outer tubing 34, described herein, will be in the form of well casing 36 deployed along the inside of borehole 32. In such applications, the smaller diameter inner tubing 42 described herein, e.g. production tubing 44, is moved downhole to a desired location inside the casing 36. By way of example, the inner tubing 42 may be retrievable tubing. Once the well casing 36 and inner tubing 42 are located in the borehole 32, the patch system (described below) may be run through the inner tubing 42 and then set in the larger well casing 36.

Figure 2:
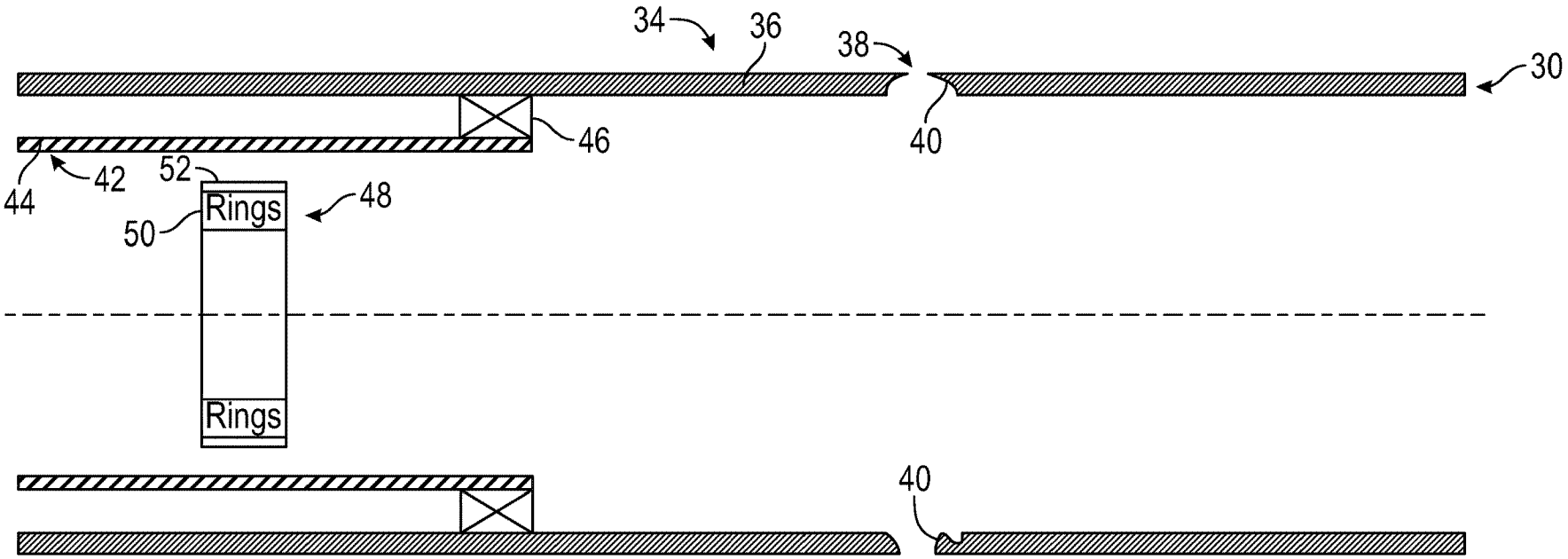
FIG. 2 is an illustration showing movement of an expansion ring through the inner tubing towards a patch zone, according to an embodiment of the disclosure.

Referring generally to FIG. 2, an example of an expansion ring 48 is illustrated in its radially contracted configuration. In this configuration, the expansion ring 48 has an outer diameter which is smaller than the inner diameter of the inner tubing 42. The expansion ring 48 may be constructed in a variety of configurations and from a variety of materials. For example, the expansion ring 48 may comprise a base member 50 formed of an expandable material, e.g. steel, which can be plastically deformed in a radially outward direction. A sealing element 52, formed of an elastomeric sealing material or other suitable sealing material, may be located along the exterior of the base member 50. It should be noted that the expansion ring 48/base member 50 also may be formed with other constructions including constructions having multiple sliding elements which are able to slide to a radially expanded position without plastic deformation. In the latter type of embodiment, the expansion rings 48 may be constructed to self lock in their expanded configuration.

Figure 3:
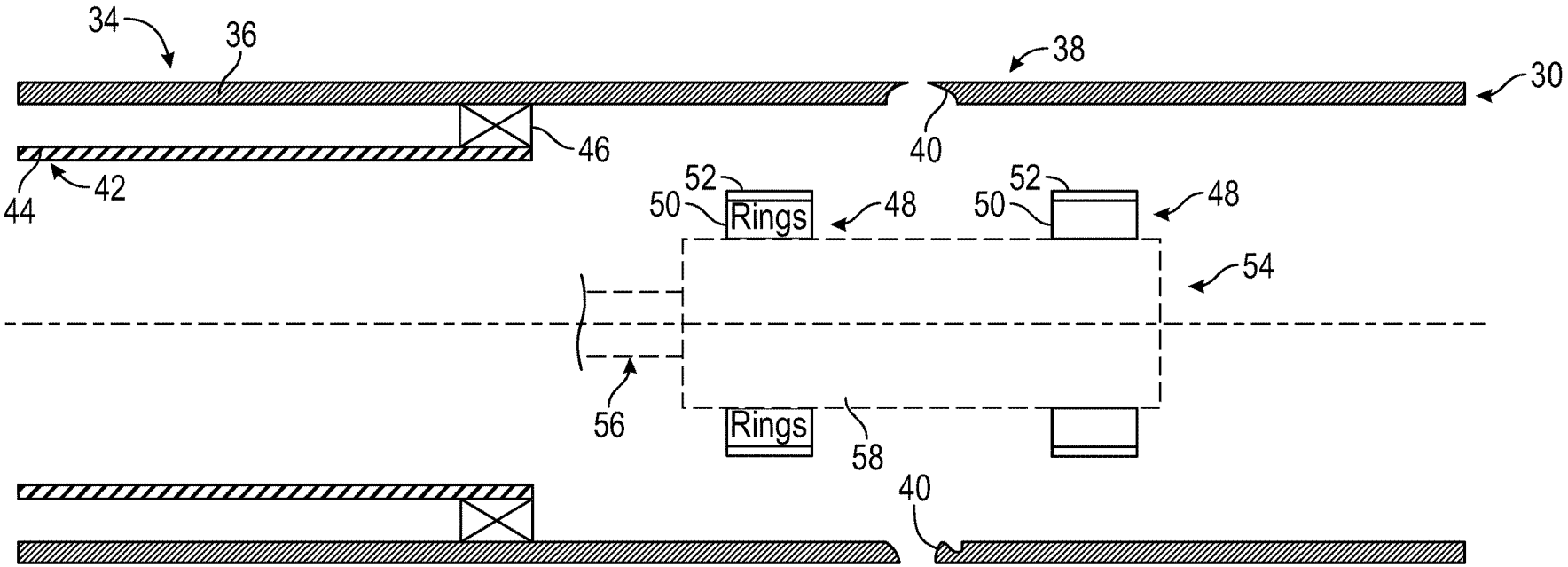
FIG. 3 is an illustration showing deployment of a plurality of the expansion rings to the patch zone via an expansion device, according to an embodiment of the disclosure.
Figure 4:
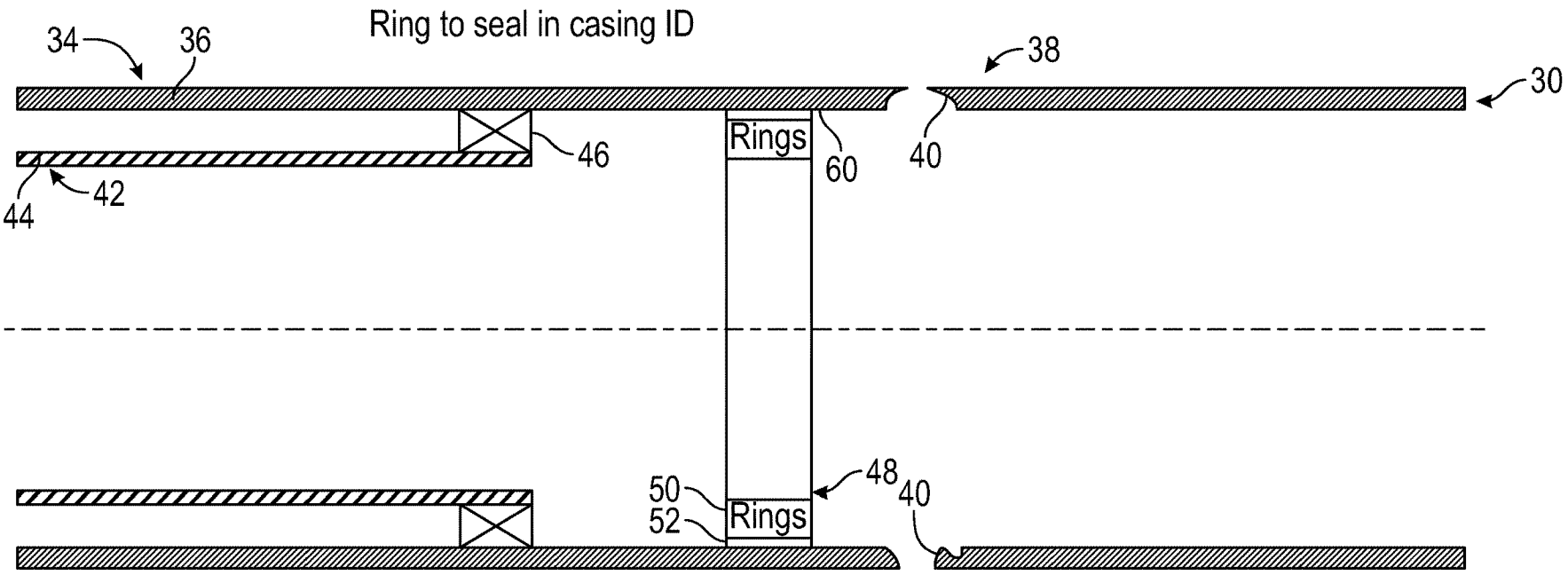
FIG. 4 is an illustration showing expansion of an individual expansion ring in a radially outward direction and into engagement with an inner surface of the outer tubing, according to an embodiment of the disclosure.
Figure 5:
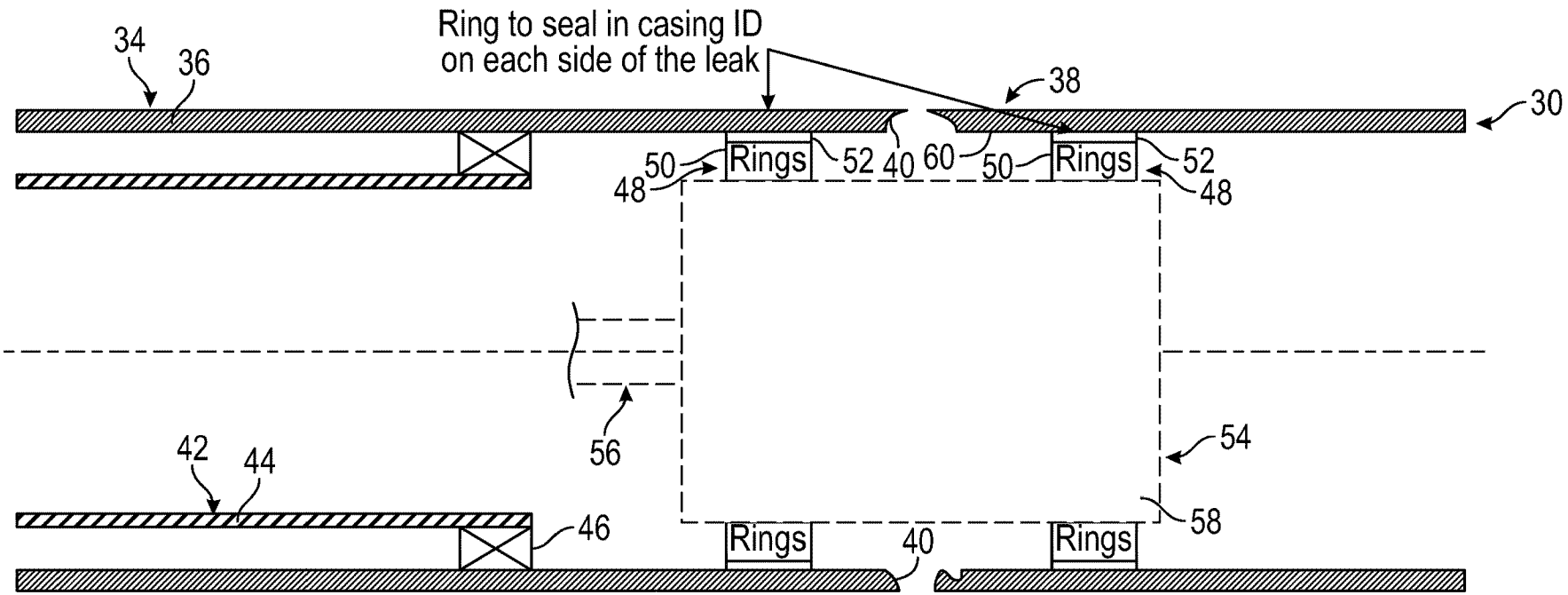
FIG. 5 is an illustration showing expansion of a plurality of the expansion rings into engagement with the inner surface of the outer tubing via the expansion device, according to an embodiment of the disclosure.

Referring generally to FIG. 3, an embodiment is illustrated in which a plurality of the expansion rings 48 is mounted on an expansion device 54. The expansion device 54 may be conveyed downhole via a conveyance 56, e.g. wireline, tubing, or another suitable conveyance. The expansion device 54 and conveyance 56 move the expansion rings 48 down through inner tubing 42, through the downhole end of inner tubing 42, and to the patch zone 38 along outer tubing 34. By way of example, the expansion device 54 may include an inflatable element 58, e.g. an inflatable bladder, which may be selectively inflated to radially expand the expansion ring or rings 48, as illustrated in FIGS. 4 and 5. The inflatable element 58 may be expanded via pressure applied downhole through conveyance 56, along the annulus surrounding conveyance 56, or through a hydraulic control line.

Referring again to FIGS. 4 and 5, the expansion rings 48 may be radially expanded by expansion device 54 to an expanded diameter configuration in which the expansion rings 48 seal against an interior surface 60 of outer tubing 34. As illustrated in FIG. 5, the expansion rings 48 may be positioned so that at least one expansion ring 48 is disposed to the downhole side of patch zone 38 and at least one expansion ring 48 is disposed to the uphole side of patch zone 38. This configuration ensures at least one expansion ring 48 is located downhole and at least one expansion ring 48 is located uphole of the hole(s) 40.

Figure 6:
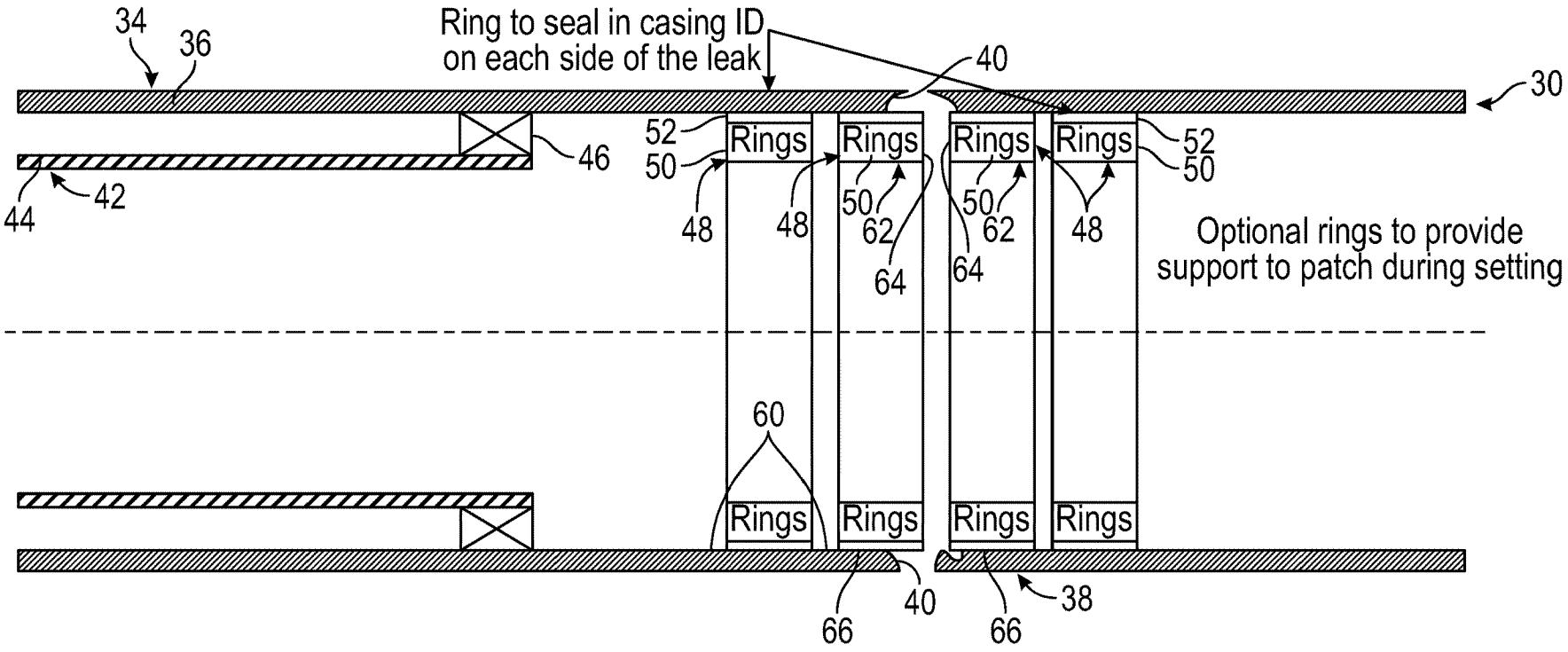
FIG. 6 is an illustration showing the plurality of expansion rings including additional rings to facilitate anchoring of the patch at a desired location in the patch zone, according to an embodiment of the disclosure.

In FIG. 6, another embodiment is illustrated in which the plurality of expansion rings 48 includes additional expansion rings 62. In this example, the additional expansion rings 62 are non-sealing expansion rings 64 positioned to support the patch system as described in greater detail below. The non-sealing expansion rings 64 may comprise anchor mechanisms 66, e.g. gripper teeth, to anchor the patch system in place. It should be noted, however, the expansion rings 48 may be constructed with various combinations of sealing elements 52 and anchor mechanisms 66 to provide sealing and anchoring functionality.

Figure 7:
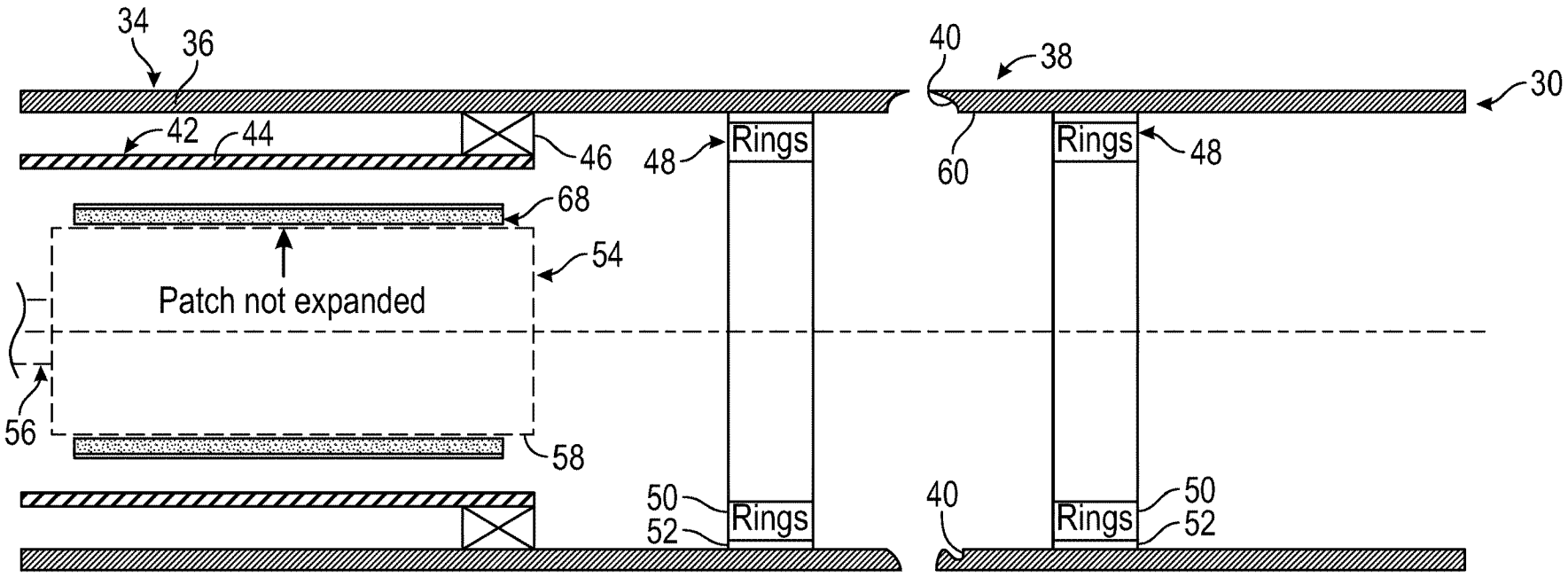
FIG. 7 is an illustration showing deployment of a tubular patch through the inner tubing, according to an embodiment of the disclosure.
Figure 8:
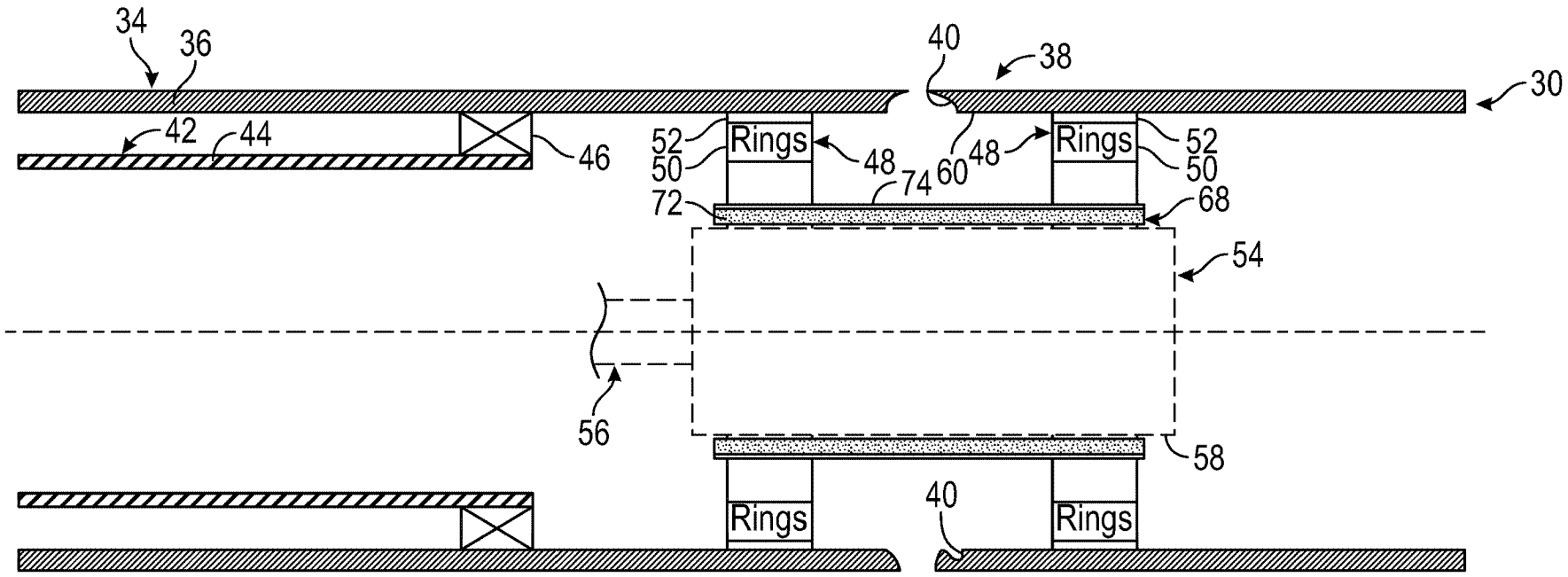
FIG. 8 is an illustration showing the tubular patch positioned within a plurality of the expansion rings which have been radially expanded into engagement with the outer tubing, according to an embodiment of the disclosure.

As further illustrated in FIG. 7, a patch 68 is deployed down through inner tubing 42. By way of example, the patch 68 may be in the form of a tubular patch. The patch 68 also may be mounted on a suitable expansion device 54, e.g. an expansion device having inflatable element 58. As with expansion rings 48, the expansion device 54 and patch 68 may be conveyed downhole via conveyance 56, e.g. wireline, tubing, or another suitable conveyance. The expansion device 54 and conveyance 56 move the patch 68 down through inner tubing 42, through the downhole end of inner tubing 42, and to the patch zone 38 along outer tubing 34, as illustrated in FIG. 8.

Figure 9:
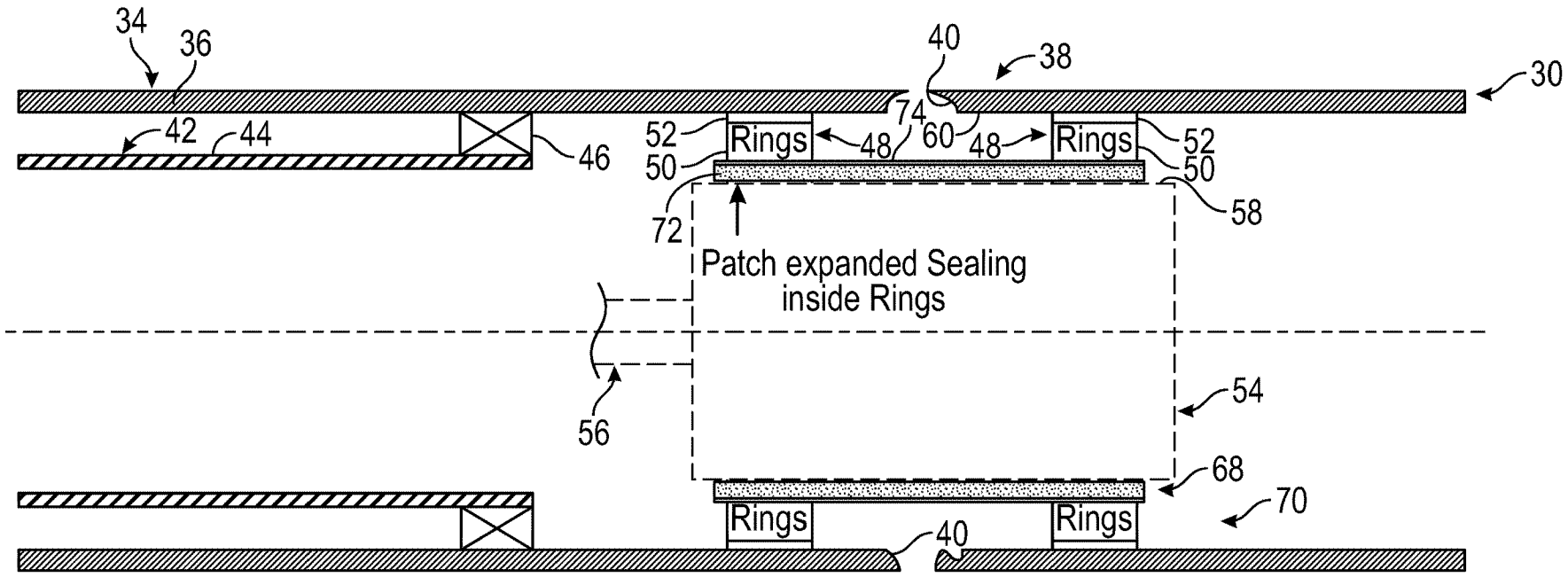
FIG. 9 is an illustration showing the tubular patch radially expanded into sealing engagement with the plurality of expansion rings, according to an embodiment of the disclosure.

Once in position, the expansion device 54, e.g. inflatable element 58, may be selectively expanded/inflated to radially expand the patch 66, as illustrated in FIG. 9. In the radially expanded configuration, the patch 68 is maintained in sealing engagement with the expansion rings 48 to form an overall patch system 70 which seals off the damaged area 40, e.g. seals off and prevents leakage through hole(s) 40.

In some embodiments, the patch 68 may be formed of an expandable steel material 72, e.g. a tube of steel, which may be plastically deformed during expansion into engagement with an interior of the corresponding expansion rings 48. A sealing element 74, e.g. an elastomeric sealing element such as rubber, may be positioned along an exterior of the patch 68 to facilitate sealing engagement with the expansion rings 48. It should be noted patch 68 also may be formed with other constructions including constructions having multiple sliding elements which are able to slide to a radially expanded position without plastic deformation. In the latter type of embodiment, the patch 68 may be constructed to self lock in the radially expanded configuration.

Depending on the parameters of a given patching operation, the overall patch system 70 may be mounted on expansion device 54 and delivered downhole collectively to patch zone 38. In this type of embodiment, the expansion device 54 would be selectively expanded to radially expand the patch 68 and the corresponding expansion rings 48 at the same time. In other embodiments, however, the expansion rings 48 are first conveyed downhole and expanded into sealing engagement with the outer tubing 34 individually or collectively. Subsequently, the patch 68 is conveyed downhole and expanded into sealing engagement with the already expanded expansion rings 48. Regardless, sealing engagement between the patch 68 and the corresponding expansion rings 48 is maintained following the radial expansion.

Various types of additional expansion rings 48, e.g. non-sealing expansion rings 64, may be used to help support patch 68 so as to prevent collapse through transverse buckling. Additionally, each of the expansion rings 48 may be constructed with appropriate anchoring mechanisms 66 to enable the expansion rings 48 to support their own weight and the weight of patch 68 once in the expanded configuration.

Figure 10:
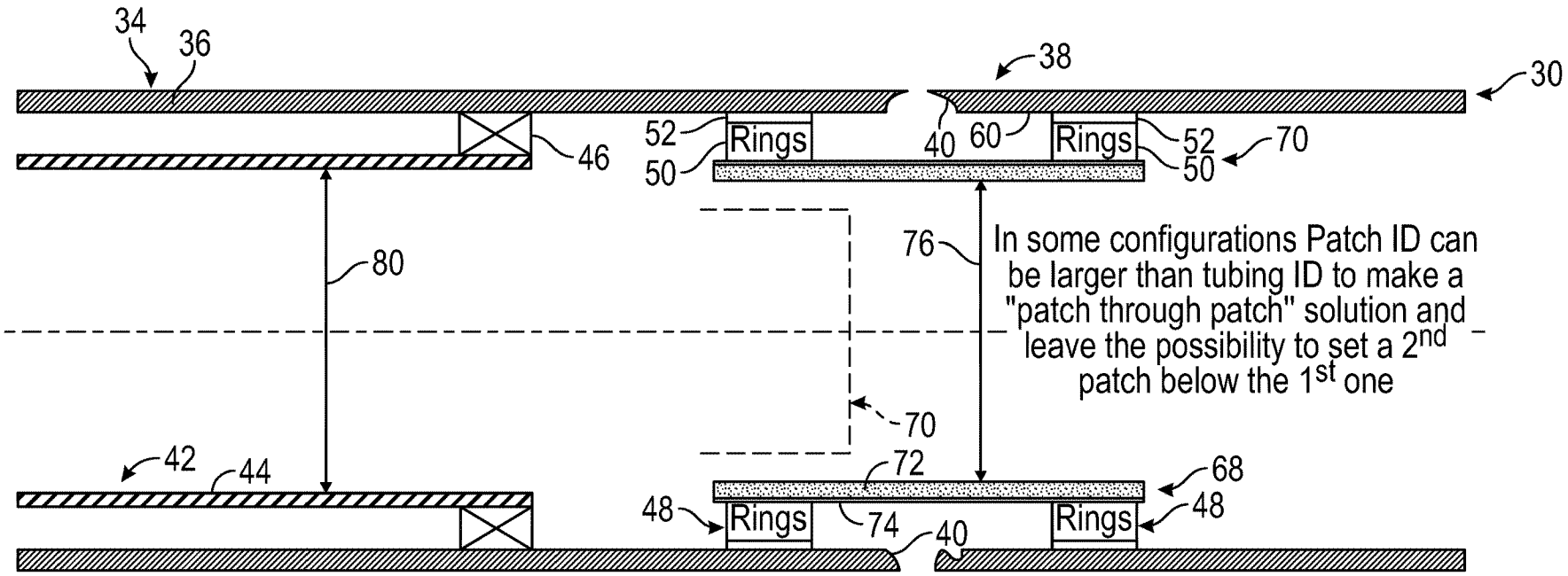
FIG. 10 is an illustration showing the capability for employing a plurality of patches by moving additional patches through an interior of a radially expanded patch system, according to an embodiment of the disclosure.

Referring generally to FIG. 10, the patch system 70 may be constructed such that an inside diameter 76 of patch 68, once expanded, is larger than the inside diameter 80 of inner tubing 42. This facilitates deployment of additional patch systems 70 (shown in dashed lines) through the expanded patch 68 to an additional patch zone or patch zones 38 located downhole of the radially expanded patch system 70. In various applications, the additional patch system 70 is deployed through a previously set patch 68 by first running the additional expansion rings 48 through the previously expanded patch 68 to a desired second patch zone 38 for expansion into the surrounding casing 36. Subsequently, an additional patch 68 is moved through the previously expanded patch 68 and into position within the expansion rings 48 located at the second patch zone 38. The additional patch 68 may then be expanded into sealing engagement with the corresponding expansion rings 48 to form the additional sealed patch system 70 at the second patch zone 38. This process may be repeated for additional patch zones 38.

Figure 11:
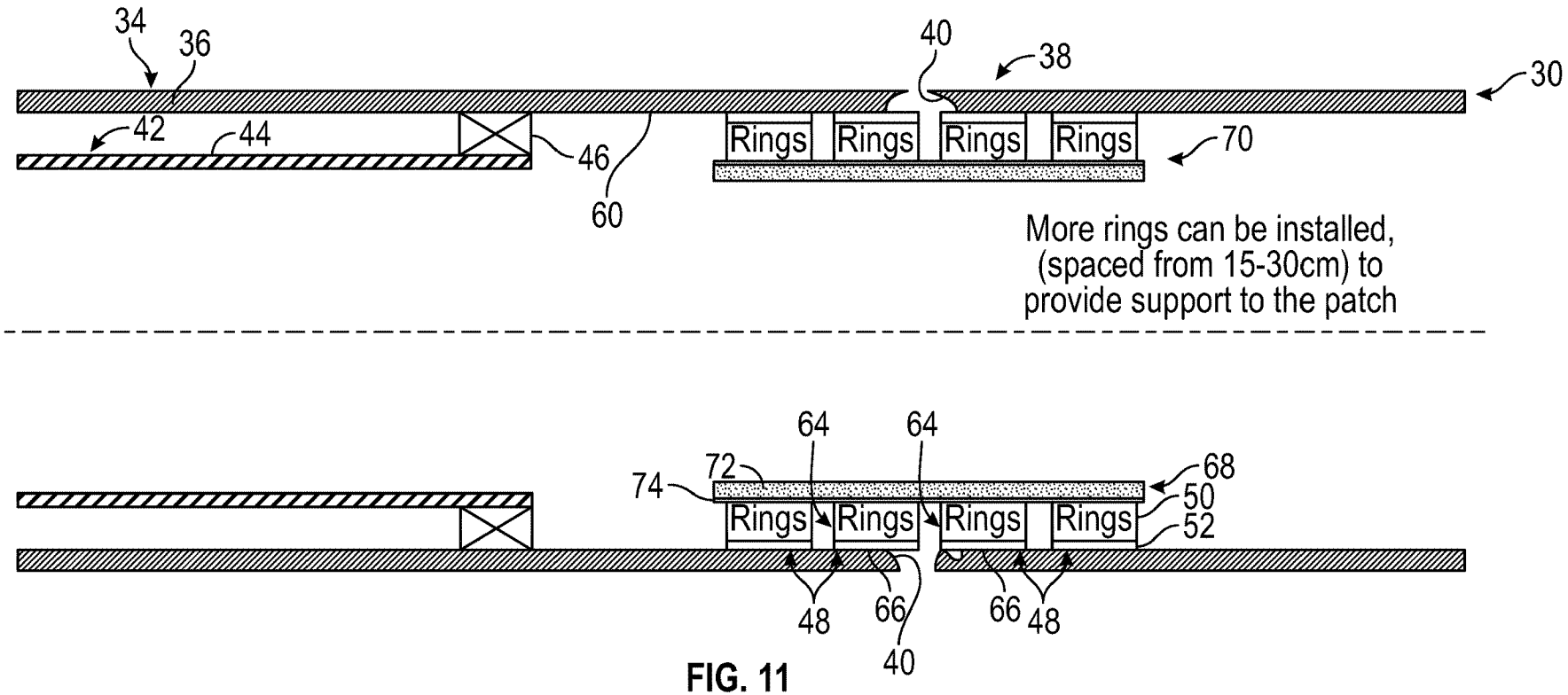
FIG. 11 is an illustration showing the expanded tubular patch which has been expanded into engagement with a plurality of expansion rings containing additional support rings, according to an embodiment of the disclosure.

As further illustrated in FIG. 11, various types of additional expansion rings 48, such as non-sealing expansion rings 64, may be expanded into engagement with the surrounding outer tubing 34. The expansion rings 48 may have various arrangements of sealing elements 52 and anchoring mechanisms 66. Additionally, the expansion rings 48 may be spaced at a desired distance from each other, e.g. 15-30 cm apart, to provide support for patch 68. However, the expansion rings 48 may be spaced from each other at a variety of other spacing distances, including distances establishing wider spaces between at least some of the expansion rings 48.

Depending on the environment and application, the patch system 70 may be constructed in various configurations. Additionally, the methodology of deploying and setting the patch system 70 may vary. For example, the expansion rings 48 may be deployed and set against outer tubing 34 first, and then the patch 68 may be deployed and expanded into engagement with the expansion rings 48. In some embodiments, the expansion rings 48 and patch 68 may be deployed and set in one run.

In some embodiments, the entry region of a patch 68 may be expanded to a larger diameter than the bore of the expanded patch 68 to create an entry cone. For example, the section of the patch 68 above the top of the topmost expansion ring 48 may be expanded to create the entry cone. The exit region of the patch 68 also can be expanded to a larger diameter to create an exit cone.

Additionally, the expansion rings 48 and/or patch 68 may be deployed by various types of conveyances 56, including wireline, coiled tubing, drill pipe, or other suitable types of conveyances. In some embodiments, an additional patch may be set inside a first patch to improve pressure ratings. The methodology also may be used to deploy other devices with or as part of the expansion rings 48 and/or patch 68. Such other devices also can be deployed downhole and combined with the expansion rings 48 and/or patch 68 during a subsequent run downhole. Examples of such devices include inflow control devices, gas lift valves, sand screens, or other suitable devices.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for patching an outer tubing in a well, comprising:

the outer tubing deployed in a borehole and having a patch zone;

an inner tubing disposed in the outer tubing and extending a portion of the distance to the patch zone;

a plurality of expansion rings with at least one expansion ring disposed on a downhole side of the patch zone and at least one expansion ring disposed on an uphole side of the patch zone, each expansion ring having an unexpanded diameter enabling movement through the inner tubing and an expanded diameter which holds the expansion ring in sealing engagement with the outer tubing;

a patch having a tubular shape, the patch being radially expandable to maintain a sealing engagement with the plurality of expansion rings;

wherein the plurality of expansion rings are expanded in sealing engagement with the outer tubing by an expansion device; and wherein the patch is expanded in sealing engagement with the expanded plurality of expansion rings, by the expansion device during a subsequent run in into the borehole.

2. The system as recited in claim 1, wherein the outer tubing comprises well casing having a larger diameter than the inner tubing and surrounding the inner tubing.

3. The system as recited in claim 1, further comprising at least one non-sealing expansion ring positioned to support the patch once the patch is radially expanded.

4. The system as recited in claim 3, wherein the at least one non-sealing expansion ring comprises an anchoring mechanism.

5. The system as recited in claim 1, wherein each expansion ring comprises an elastomeric sealing material oriented to seal against an interior surface of the outer tubing.

6. The system as recited in claim 1, wherein the patch is an expandable steel patch.

7. The system as recited in claim 1, wherein the expansion rings of the plurality of expansion rings are expanded prior to expanding the patch.

8. The system as recited in claim 1, wherein the expansion device has an inflatable element.

9. The system as recited in claim 1, wherein the patch comprises a plurality of patches positioned at a plurality of patch zones.

10. The system as recited in claim 1, wherein the patch zone comprises an opening extending laterally through a wall of the outer tubing.

11. A method, comprising:

moving a plurality of expansion rings through an interior of a first tubing deployed in a borehole and out through a downhole end of the first tubing;

positioning the plurality of expansion rings in a patch zone of a second tubing having a larger diameter than the first tubing;

expanding the plurality of expansion rings into engagement with an interior surface of the second tubing;

expanding a tubular patch to an expanded configuration within the plurality of expansion rings in a manner which maintains sealing engagement with the plurality of expansion rings; and wherein the tubular patch is expanded during a subsequent run in into the borehole after the plurality of expansion rings are engaged with an interior surface of the second tubing.

12. The method as recited in claim 11, wherein expanding the plurality of expansion rings comprises expanding elastomeric sealing elements into sealing engagement with the interior surface.

13. The method as recited in claim 12, wherein expanding the plurality of expansion rings comprises expanding an anchor mechanism into engagement with the interior surface.

14. The method as recited in claim 11, wherein moving comprises moving the plurality of expansion rings through the first tubing which is in the form of production tubing.

15. The method as recited in claim 11, wherein positioning comprises positioning at least one expansion ring on each side of an opening extending laterally through a wall of the second tubing.

16. The method as recited in claim 11, wherein positioning comprises positioning at least one expansion ring on each side of an opening extending laterally through a wall of the second tubing which is in the form of well casing.

17. The method as recited in claim 11, further comprising moving a second plurality of expansion rings and a second patch through the plurality of expansion rings and the patch to a second patch zone.

18. The method as recited in claim 11, further comprising forming at least one of the top end or the bottom end of the tubular patch into a cone.

19. A system, comprising:

an expandable patch system having a plurality of expansion rings sized for movement through an interior of a well tubing, at least two expansion rings of the plurality of expansion rings having sealing elements oriented to seal against an interior tubing surface, the expandable patch system further comprising a tubular patch, the tubular patch being radially expandable along the interior of the expansion rings to ensure a sealing engagement with the plurality of expansion rings; and wherein the tubular patch is expanded during a subsequent run in into the well tubing after the plurality of expansion rings are engaged with the interior tubing surface.

20. The system as recited in claim 19, wherein the plurality of expansion rings comprises more than two expansion rings.

* * * * *